United States Patent [19]

Tirums

[11] Patent Number: 5,056,162

[45] Date of Patent: Oct. 15, 1991

[54] FORM-FITTING, ENERGY-ABSORBING MATERIAL AND METHOD FOR MAKING THE SAME

[75] Inventor: Andrew T. Tirums, San Jose, Calif.

[73] Assignee: Kaiser Aerospace & Electronics Corporation, Oakland, Calif.

[21] Appl. No.: 534,779

[22] Filed: Jun. 7, 1990

[51] Int. Cl.[5] ..... A42B 3/00

[52] U.S. Cl. ..... 2/412; 2/417; 428/306.6

[58] Field of Search ..... 2/410, 411, 412, 414, 2/417, 425; 428/306.6, 308.4; 36/88, 93, 98

[56] References Cited

U.S. PATENT DOCUMENTS

| | | | |
|---|---|---|---|
| 3,848,287 | 11/1974 | Simonsen | 36/88 |
| 4,020,507 | 5/1977 | Morton | 2/411 |
| 4,128,951 | 12/1978 | Tansill | 36/71 |
| 4,288,268 | 9/1981 | Hartung | 2/410 |
| 4,316,934 | 2/1982 | Maier et al. | 428/308.4 |
| 4,345,338 | 8/1982 | Frieder, Jr. et al. | 2/414 |
| 4,412,358 | 11/1983 | Lavender | 2/412 |
| 4,432,099 | 2/1984 | Grick et al. | 2/414 |
| 4,433,494 | 2/1984 | Courvoisier et al. | 36/93 |
| 4,466,138 | 8/1984 | Gessalin | 2/410 |
| 4,683,877 | 8/1987 | Ersfeld et al. | 428/308.4 |
| 4,690,860 | 9/1987 | Radvan et al. | 428/306.6 |
| 4,809,379 | 3/1989 | Jungwirth | 36/93 |
| 4,888,225 | 12/1989 | Sandvig et al. | 36/88 |
| 4,946,726 | 8/1990 | Sandvig et al. | 428/308.4 |

FOREIGN PATENT DOCUMENTS

| | | | |
|---|---|---|---|
| 1160414 | 1/1984 | Canada | 2/411 |
| 2749816 | 5/1979 | Fed. Rep. of Germany | 2/411 |
| 2335169 | 8/1977 | France | 2/412 |
| 2340066 | 10/1977 | France | 2/412 |
| 2379262 | 10/1978 | France | 2/412 |
| 2561877 | 10/1985 | France | 2/425 |
| 1174407 | 8/1986 | Japan | 2/411 |
| 63-78711 | 4/1988 | Japan | 428/306.6 |
| 1313415 | 5/1987 | U.S.S.R. | 36/98 |

*Primary Examiner*—Werner H. Schroeder
*Assistant Examiner*—Michael A. Neas
*Attorney, Agent, or Firm*—Townsend and Townsend

[57] ABSTRACT

A helmet system includes a helmet shell and an energy-absorbing helmet liner that is constructed from an open-cell urethane foam impregnated with a room-temperature curable thermoset epoxy. The impregnated foam liner is inserted in the helmet shell, heated until the liner becomes deformably plastic, and placed on the head of a user, permitting custom-fitting of the helmet system that conforms to the contours of the user's head. When cured by cooling, the liner assumes a rigid construction that, by custom-fitting, repeatably aligns the helmet shell to the head of the user, and is crushable to absorb energy.

19 Claims, 1 Drawing Sheet

FORM-FITTING, ENERGY-ABSORBING MATERIAL AND METHOD FOR MAKING THE SAME

The present invention is directed to custom-fitting a part or element to the contours of another and, more particularly, to an energy-absorbing liner that can be custom-fitted to the body part of a person such as, for example, custom-fitting a helmet to the contours of the person's head.

BACKGROUND OF THE INVENTION

Military helmets, and particularly flight helmets (i.e., those worn by pilots, crew members and the like of military aircraft) have as a primary function the prevention of penetration of flying objects such as, for example, shrapnel, pieces of aircraft structure in the event of ejection or crash, and the like. However, of recent date the shell has also been serving as a mounting point for such articles as oxygen masks, microphones, earcups, and the like, and more recently precision optics which must maintain accurate alignment to the wearer's eye. It is highly desirable that the alignment be maintained during high gravity-inducing maneuvers and aerodynamic buffeting. It is for this reason that helmets carrying such optics should be custom-fitted to the contours of the head of the wearer.

Various methods and techniques are presently available for custom-fitting articles to the body parts of persons. Certain of these involve, for example, custom-fitting shoes, boots, and inserts and the like to a foot. While perhaps applicable to their intended use, many of these methods can pose problems if attempted to be used outside their intended use. For example, such techniques often require a person's body part (i.e., foot) to be placed in a container (shoe or boot), the container filled with a compound, and the compound allowed to cure to the shape of the foot over a period of time. Further, the compounds used in these techniques often include various materials and solvents that may be relatively benign when cured, but before curing and in their liquid state these compounds can be hazardous—particularly if used near the face, eyes, etc. Thus, such problems can prohibit use of certain of these techniques in connection with custom-fitting, for example, a helmet to a human head.

In addition to the toxicity posed by certain known techniques for custom-fitting, many of them are also gravity-dependent, requiring the body part (i.e., foot) to be placed into a container for surrounding by the compound. Additionally, the curing process can often approach ten minutes or more, requiring the subject to hold a position for some time.

Examples of the aforementioned techniques may be found in U.S. Pat. Nos. 3,325,919, 3,848,287 and 4,128,951.

Other custom-fitting methods use a resilient heat-softened foam of one type or another. However, the resultant heat-treated foam maintains its resiliency after cooling and, therefore, provides little in the way of energy-absorbing capability.

Another known method used in custom-fitting many of the current military helmets utilizes layers of a thermoplastic "bubble" material which softens when heated. Unfortunately, the material tends to regain its original, premolded shape with time. Examples of this technique are found in U.S. Pat. Nos. 4,412,358 and 4,432,099.

It can be seen, therefore, that a need exists for a material that can function to custom-fit one part to another, such as, for example, a helmet to the contours of the head of the user, that is safe and easy to use.

SUMMARY OF THE INVENTION

Accordingly, there is disclosed a material, and a method for fabricating that material, that is capable of being form-fitted to the contours of a part in a manner that is simple, safe, and easy to use. The invention was discovered in connection with developing a liner for custom-fitting a helmet to a person's head. Therefore, the remainder of this disclosure will discuss the invention in that context. It will be seen by those skilled in this art, however, that the invention is capable of use beyond that disclosed herein.

Thus, disclosed herein is a helmet liner, and a method for constructing the liner, that functions to custom-fit the helmet to the contours of the head of a wearer so that the helmet shell can be maintained in accurate alignment to the wearer's eye. In addition, the liner so formed has a "crushable" construction so that it is capable of absorbing energy from impacts to the helmet, thereby providing a reliable energy-absorbing system.

According to the method of the present invention a helmet liner is formed from an open-cell foam impregnated with a room-temperature-curable thermoset epoxy that is plastically deformable at an elevated temperature. To custom-fit a helmet, the impregnated liner is first heated to a temperature that softens the thermoset epoxy, making the liner plastically deformable. The liner is, while malleable, then inserted in the helmet. The helmet and liner are placed on the head of a wearer, positioned, and allowed to cool. As the liner cools it will conform to the contours of the head of the wearer, forming a custom-fitted, energy-absorbing (i.e., crash protective) liner that maintains the helmet shell in relatively accurate alignment with the eyes of the wearer.

In the preferred embodiment the liner is formed from a urethane open-cell foam, having a density in the range of 1.8–2.2 pounds per cubic foot (preferably, approximately 2 pounds per cubic foot for the use intended herein). The ratio of impregnated weight to unimpregnated weight of the liner is preferably in the range of about 2.4–3.0.

There are a number of advantages that flow from the present invention. First, there is provided a helmet liner capable of performing both functions of custom-fitting a helmet to the head contours of a wearer. Thereby, an alignment between the helmet (and anything carried by the helmet) and the wearer (e.g., the wearer's eyes) is established, and can thereafter be repeatedly re-established. Second, the custom-fitting liner also performs an energy-absorbing function: When re-cured after custom-fitting the liner of the present invention forms, in effect, a crushable structure which absorbs energy by collapsing. Third, use of an open-cell construction provides, through its porosity, the benefit of being "breathable," permitting some air flow to the wearer's head. This feature permits the evaporation of perspiration, reducing a possible source wearer discomfort.

These and other advantages and benefits of the present invention will become apparent to those skilled in this art upon a reading of the following details of the invention, which should be taken in conjunction with the accompanying drawings.

DETAILED DESCRIPTION OF THE PREFERRED EMBODIMENTS

Figure 1:
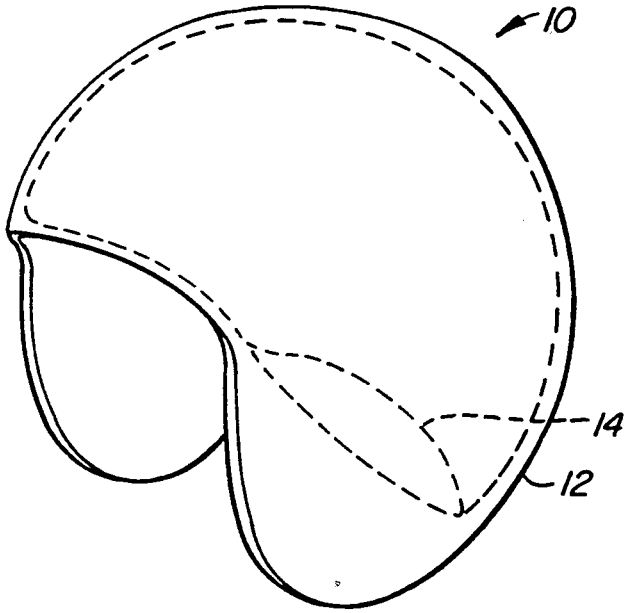
FIG. 1 is an illustration of a helmet shell containing a liner constructed according to the present invention.

Turning now to the Figures, and in particular FIG. 1, there is illustrated a helmet system utilizing a helmet liner constructed according to the teachings of the present invention. Designated generally with the reference numeral 10, the helmet system 10 is shown as comprising a helmet shell 12 which would normally be fabricated from multiple laminations of a composite material such as sold those fabricated from a product sold under the trademark Kevlar, and/or similar composite materials. While a principal function of the shell is to protect the wearer's head, it can also operate as a mounting point for such devices as, for example, precision optics systems (not shown) that require accurate alignment of the shell (and the mounted optics) with the wearer's eyes.

Figure 3:
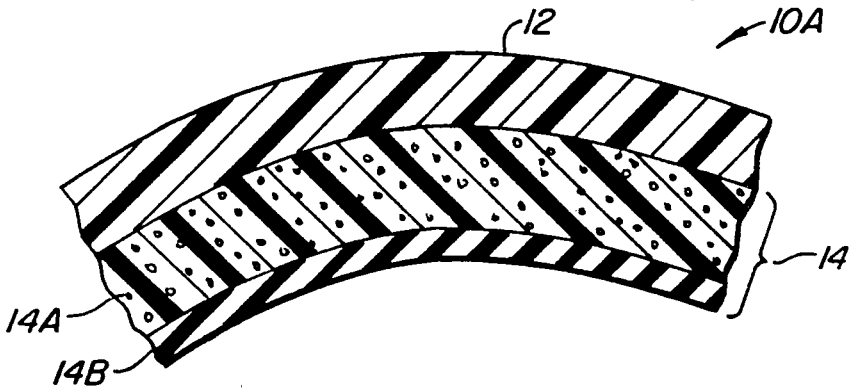
FIG. 3 is a sectional view of a helmet system, illustrating generally the various layers, including the energy-absorbing, custom-fitting liner of the present invention.

Mounted within the helmet shell 12, for placement between the interior surface of the helmet shell 12 and a wearer's head (not shown), is a liner combination 14 (illustrated in phantom in FIG. 1). As perhaps better illustrated in the partial sectional view of the helmet system 10 in FIG. 3, the liner combination comprises an energy-absorbing liner 14A located adjacent the interior surface of the helmet shell 10, and an inner comfort liner 14B, located to be positioned next to the head (not shown) of the wearer.

The energy-absorbing liner 14A is mounted to, and held in place in, the helmet shell 12 by a removable adhesive system (such as that sold under the trademark Velcro), as indicated at the points 16 on the energy-absorbing liner 14A.

The energy-absorbing liner 14A is constructed from an open-cell urethane foam that preferably has a density in the range of about 1.8–2.2 pounds per cubic foot, and a thickness in the range of $\frac{3}{8}''$–$\frac{5}{8}''$. In a preferred embodiment of the helmet system 10, the energy-absorbing liner 14A is constructed from an open-cell foam having a density of approximately 2 pounds per cubic foot and is $\frac{1}{2}''$ thick.

The open-cell urethane foam used to construct the energy-absorbing liner 14A is prepared by immersion in a room-temperature-curable thermoset epoxy, i.e., an epoxy that cures at a low temperature (approximately 20° C.), yet becomes plastically deformable at an elevated temperature.

The epoxy is allowed to impregnate the open-cell urethane until the ratio of impregnated weight of foam to unimpregnated weight falls within a range of preferably 2.4–2.6, although the ratio of as high as 3.0 would obtain good results. If the urethane foam contains too much epoxy, it may be placed between two sheets of absorbent material (e.g., lab towels) and passed through a roller or press to remove the excess epoxy.

The impregnated urethane foam is then placed on a mold used to configure and form the energy-absorbing liner 14A, and allowed to cure for a minimum of 24 hours. The mold preferably is sized to that the head-receiving cavity 20 of the energy-absorbing liner 14A is formed to be somewhat undersized for reasons that will be explained below. After room temperature cure a cloth cover (shown only to the extent the cloth cover may include the comfort layer 14B—FIG. 3—as a part thereof) can be installed. Cloth covers are known, and are used to shield helmet liners from the helmet as well as to provide a layer of soft material between the wearer's head and the liner. Here, the cloth cover (not shown) preferably has as a part thereof, and carries, the comfort layer 14B.

Digressing somewhat for the moment, it should be evident to those skilled in this art that the epoxy used in the construction of the energy-absorbing liner 14A is preferably non-toxic. Such a non-toxic epoxy is a room-temperature-cure epoxy manufactured by Hexcel Corporation, of Chatsworth, Calif., and sold under the identification "HEXCEL 2410" which has been found preferable in constructing the energy-absorbing liner 14A.

Figure 2:
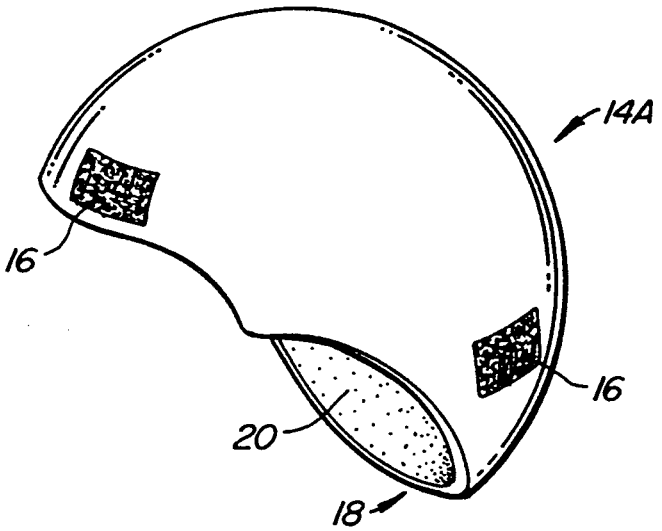
FIG. 2 is an illustration of the liner constructed in accordance with the present invention.

The liner 14A, constructed in accordance with the above procedure, is now ready to be used to custom-fit a helmet shell 12 to a wearer according to the following procedure: First, preferably, a thermocouple (not shown) is inserted into the liner 14A approximately one inch. The preferred location would be the nape area 18 of the liner (FIG. 2). The liner 14A is then placed in a temperature chamber that has been preheated to approximately 250° F., and the liner heated to approximately 230°–240° F., placing the liner in a plastically deformable state. This temperature, of course, depends upon the make-up of the thermostat epoxy used. The liner 14A is then removed and placed in the helmet shell 16.

The subject to be fitted dons a standard military issue "skullcap" (not shown). Such skullcaps are worn to protect a helmet's inner liner from soiling due to perspiration, grease and oils from the wearer's hair, and the like. They (the skullcaps) are easier to clean than whatever comes into contact with the wearer's head and for that reason are often used. Here, it is helpful in alleviating discomfort that may be caused by warmth from the heated liner.

The helmet system 10, including the heated (and plastically deformable) energy-absorbing liner 14A, is placed on the subject's head. Since the head-receiving cavity 20 of the energy-absorbing liner 14A was originally formed somewhat undersized, the helmet system should be and is positioned as desired. The energy-absorbing liner 14A is allowed to cool. In approximately two minutes (or when it cools to approximately 165° F. on the thermocouple) the liner will lose all resilience, and can be removed.

If the fit is not correct, the liner can be placed back into the temperature chamber and the process repeated.

During the fitting process the Velcro tabs 16 will have covers (not shown) protecting them so that the liner 14A can be more easily inserted into and removed from the helmet shell 12 during the fitting process. After the fit is found correct, the covers can be removed from the Velcro tabs 16 and the liner installed in the helmet shell 12.

There are some caveats: The liner is comprised of a resilient urethane, open-cell foam impregnated with a thermoset material. The thermoset impregnation will fully cure if allowed to stay at an elevated temperature for prolonged periods. Once so cured, the application of heat will no longer soften the liner. Accordingly, care should be taken as to how long the liner 14A is held at its elevated temperature.

Further, the liner can be refitted about five times before the thermoset impregnation cures and can no longer be softened by elevated temperatures. The amount of time the liner can be refitted will decrease, depending upon how long it has been kept at the higher temperatures.

In conclusion, there has been disclosed a material constructed from a urethane open-cell foam impregnated with a room-temperature-cured thermoset epoxy that finds particular use as a custom-fit, energy-absorbing helmet liner. Raising the temperature of the impregnated foam softens the liner so that it can be fitted to the head of a wearer, adjusting to the contours of the wearer's head. However, as indicated above, those skilled in this art will readily appreciate that although the invention is disclosed in connection with its use as a helmet liner, it can enjoy utilization beyond that of a liner. For example, the material can be used to custom-fit various other body parts to an article such as feet to shoes. Further, by using a denser open-cell foam, the material can be used to form a stable, custom-fitted article to hold a body-part (e.g., arm or leg) immobile. In this latter case, it may be desirable to use a denser foam to obtain, when cured, a product capable of sustaining a load. Thus, 40–60% open-cell foam may be found to be more desirable in such applications. Alternatively, a lighter product, still having some load-bearing capability, may be produced using 60–80% open-cell foam.

What is claimed is:

1. A material selectively formed to custom-fit to the contours of a body-part of a person, the material comprising:

a sheet of open-cell urethane foam impregnated with a room-temperature curable thermoset epoxy that is also plastically deformable at elevated temperatures;

wherein the impregnated sheet of foam is deformable at elevated temperatures to fit to the contours of the body-part of the person.

2. The material of claim 1, wherein foam is of a type about 85%–95% open cell.

3. The material of claim 1, wherein the material has a ratio of impregnated weight to unimpregnated weight in the range of about 2.4 to 3.0.

4. A method for producing a material for use as an energy-absorbing, formable liner that conforms to the contours of a body-part of a person, the method comprising the steps of:

forming the material from an open-cell urethane foam impregnated with a room-temperature curable thermoset epoxy that is plastically deformable at an elevated temperature, the ratio of impregnated weight to unimpregnated weight of the liner being the range of about 2.4 to 3.0;

heating the material to a temperature that causes the material to become plastically deformable;

fitting the material to the body-part of a person, and allowing the material to cool until the material becomes non-plastic.

5. The method of claim 4, wherein the open-cell urethane foam has a density in the range of about 1.8–2.2 pounds per cubic foot.

6. The method of claim 4, wherein the open-cell foam is 50–60% open-cell.

7. The method of claim 4, wherein the heating step includes heating the liner to a temperature in the range of about 230 degrees–240 degrees Fahrenheit.

8. The method of claim 5, wherein the open-cell urethane foam has a thickness in the range of about $\frac{3}{8}$ inch–$\frac{5}{8}$ inch.

9. An energy-absorbing, formable liner for a helmet, comprising:

an open-cell foam having a density in the range of about 1.8–2.2 pounds per cubic foot and a thickness in the range of about $\frac{3}{8}$ inch–$\frac{5}{8}$ inch, the foam being impregnated with a room-temperature curable thermoset epoxy that is plastically deformable at an elevated temperature, the ratio of impregnated weight to unimpregnated weight of the liner being the range of about 2.4 to 3.0, the foam being cut to a pattern to fit within the helmet.

10. A helmet system, comprising:

a helmet shell formed and configured to receive the head of a wearer;

a helmet liner inserted in the helmet shell, between an interior surface of the helmet shell and the head of the wearer, the helmet liner being constructed of an open-cell foam impregnated with a room-temperature curable thermoset epoxy that is plastically deformable at an elevated temperature so that when heated to the elevated temperature the helmet liner substantially conforms to the head of the wearer.

11. The helmet system of claim 10, wherein the open-cell foam has a density in the range of about 1.8–2.2 pounds per cubic foot.

12. The helmet system of claim 10, wherein the ratio of the impregnated weight to the non-impregnated weight of the helmet liner is in the range of about 2.4 to 3.0.

13. The helmet system of claim 10, wherein foam is of a type about 85%–95% open cell.

14. The helmet system of claim 10, wherein the impregnated open-cell foam becomes plastically deformable at a temperature in the range of about 230 degrees–240 degrees fahrenheit.

15. A helmet system, comprising:

a helmet shell formed and configured to receive the head of a wearer;

a helmet liner inserted in the helmet shell, between an interior surface of the helmet shell and the head of the wearer, the helmet liner being constructed of an open-cell foam having a density in the range of about 1.8–2.2 pounds per cubic foot impregnated with a room-temperature curable thermoset epoxy that is plastically deformable at an elevated temperature in the range of about 160 degrees–170 degrees Fahrenheit so that when heated to the elevated temperature the helmet liner substantially conforms to the head of the wearer, the ratio of the impregnated weight to the non-impregnated weight of the helmet liner is in the range of about 2.4 to 3.0.

16. The helmet system of claim 15, wherein the helmet liner has a thickness dimension in the range of about $\frac{3}{8}$ inch–$\frac{5}{8}$ inch.

17. The helmet system of claim 16, including a comfort liner positioned interior of the helmet shell for placement between the helmet liner and the head of the wearer.

18. The helmet system of claim 17, wherein the comfort liner has a thickness dimension in the range of about 1/16 inch–$\frac{1}{4}$ inch.

19. The helmet system of claim 18, wherein the comfort liner is formed from an open-cell foam.

* * * * *